US009469508B2

(12) United States Patent
Lee

(10) Patent No.: US 9,469,508 B2
(45) Date of Patent: Oct. 18, 2016

(54) SAFETY COMB PLATE OF ESCALATOR

(71) Applicant: MIJUHITEC CO., LTD., Seoul (KR)

(72) Inventor: Ho Yeon Lee, Seoul (KR)

(73) Assignee: MIJUHITEC CO., LTD., Seoul (KR)

( * ) Notice: Subject to any disclaimer, the term of this patent is extended or adjusted under 35 U.S.C. 154(b) by 0 days.

(21) Appl. No.: 14/900,981

(22) PCT Filed: Jun. 10, 2014

(86) PCT No.: PCT/KR2014/005072

§ 371 (c)(1),
(2) Date: Dec. 22, 2015

(87) PCT Pub. No.: WO2014/208906

PCT Pub. Date: Dec. 31, 2014

(65) Prior Publication Data

US 2016/0145078 A1 May 26, 2016

(30) Foreign Application Priority Data

Jun. 26, 2013 (KR) ..... 10-2013-0073494

(51) Int. Cl.
*B66B 25/00* (2006.01)
*B66B 29/06* (2006.01)
*B66B 23/14* (2006.01)

(52) U.S. Cl.
CPC ..... *B66B 29/06* (2013.01); *B66B 23/14* (2013.01); *B66B 25/006* (2013.01)

(58) Field of Classification Search
CPC ..... B66B 25/00; B66B 25/006; B66B 29/00; B66B 29/08; B66B 29/06; B66B 23/14
USPC ..... 198/323, 325
See application file for complete search history.

(56) References Cited

U.S. PATENT DOCUMENTS 3,137,382 A * 6/1964 Conover ..... B66B 29/06 198/325
3,233,717 A * 2/1966 Jin ..... B66B 29/06 198/323
5,255,771 A * 10/1993 Nurnberg ..... B66B 29/06 198/323
5,611,417 A * 3/1997 Stawniak ..... B66B 29/06 198/323
5,718,319 A * 2/1998 Gih ..... B66B 29/06 198/323
6,241,070 B1 * 6/2001 Loder ..... B66B 29/06 198/323
6,644,457 B2 * 11/2003 Lauch ..... B66B 29/06 198/322
6,976,571 B2 * 12/2005 Schops ..... B66B 29/06 198/323

FOREIGN PATENT DOCUMENTS

JP 06-032579 2/1994
JP 07-05575 1/1995
KR 1019990074475 10/1999

OTHER PUBLICATIONS

International Search Report mailed Aug. 21, 2014 for PCT/KR2014/005072.

* cited by examiner

*Primary Examiner* — James R Bidwell
(74) *Attorney, Agent, or Firm* — Kramer Amado P.C.

(57) ABSTRACT

A comb plate is provided that can be monitored whether entire teeth are damaged by continuously installing one detection line in order to detect damage of teeth of a comb plate fixed to the front of a landing plate of an escalator and that has a simple configuration for damage detection and that can minimize a cost for monitoring the teeth by using only one detection line while monitoring the entire of a plurality of comb teeth provided in the comb plate.

5 Claims, 11 Drawing Sheets

SAFETY COMB PLATE OF ESCALATOR

BACKGROUND OF THE INVENTION

1. Field of the Invention

The present invention relates to a safety comb plate of an escalator, and more particularly, to a safety comb plate of an escalator that can quickly detect teeth damage, when teeth of the comb plate applied to the escalator are damaged and that can stop the escalator and output warning broadcasting, when teeth are damaged, thereby preventing an unexpected accident from occurring.

2. Description of the Related Art

In general, escalators and moving walks are devices for vertical or horizontal transportation of pedestrians and are installed and operated in various public facilities such as department stores, subways, and government offices.

In such escalators and moving walks, as shown in FIGS. 1 and 2, a comb plate 3 vertically installed according to a moving direction of the escalator or the moving walk is installed at the front of a landing plate 2 in which a user steps when the user gets off an escalator or a moving walk so as to contact with a step type foothold 1 in which the user steps in the escalator and a flat type foothold 1 of the moving walk and thus the comb plate 3 is fixed and installed to prevent a foreign substance attached to or dropped to the step type and flat type foothold 1 from being inserting into an internal mechanical device.

The user of such an escalator or moving walk steps on the foothold 1 moving upward and downward in the landing plate 2 installed to prevent slip, vertically moves with holding a moving slim line 4 in a banister, when vertically moving, determines a position of the comb plate 3 installed at the front of the landing plate 2 of a destination and moves the user's feet to the landing plate 2 and gets off the escalator or the moving walk according to a moving speed so as to prevent the feet from hitting, when getting off the escalator or the moving walk.

In this case, when getting off the foothold of the escalator or the moving walk, the user should prevent from falling down or another accident from occurring, as the user's feet collide with the comb plate by paying attention.

At a surface of the foothold 1, a guide groove is formed in a moving direction of the foothold 1, and teeth that guide the guide groove are formed in a front end portion of the comb plate 3 to prevent a shoelace or a partial body of the user from being inserted.

However, when the user gets on the escalator or the moving walk, the foothold 1 may shake due to a gap of the left and right side and thus the teeth formed at the front end portion of the comb plate 3 is frequently damaged, and when the user's shoelace or finger is inserted into a damaged portion, a safety accident may occur and thus when the teeth are damaged, by quickly stopping operation of the escalator or the moving walk, a subsequent accident should be prevented from occurring.

However, such an escalator or moving walk is installed in the plural within public buildings, and it is almost impossible for a manager to often manage whether teeth of the comb plate 3 installed at the front of the landing plate 2 of the escalator are damaged.

Further, because teeth of the comb plate 3 are often damaged, when the teeth of the comb plate 3 are partially damaged, the entire comb plate 3 should be replaced from the landing plate 2 and thus a much maintenance cost is consumed.

SUMMARY OF THE INVENTION

The present invention has been made in view of the above problems, and provides a safety comb plate of an escalator that can prevent an unexpected safety accident of a user by immediately stopping driving of an escalator with rapid detection, even if teeth of a comb plate of an escalator are partially damaged.

The present invention further provides a safety comb plate of an escalator that can reduce a maintenance cost by minimizing a replacement portion, when teeth of a comb plate of an escalator are partially damaged.

In accordance with an aspect of the present invention, a safety comb plate of an escalator including a plate body fixed to the front of a landing plate and a comb portion provided at the front end of the plate body and in which a plurality of teeth protruded to the front towards a foothold maintain a constant gap, wherein at teeth, a detection line that blocks transmission of a detection signal with a control means that controls driving of the escalator by disconnecting is provided, when the teeth are damaged, the control means determines that the teeth are damaged, when a detection signal is not input from the detection line to stop a driving motor that drives the foothold of the escalator and to output with sound a failure message of the escalator through a speaker, when it is determined that the teeth are damaged, the control means transmits comb plate repair request information notifying that the teeth of the comb plate are damaged to a smart phone, which is a mobile terminal of a manager through a remote communication module, the plate body and the comb portion of the comb plate are dividedly produced, and at the front end of the plate body, insertion grooves are formed in a right and left side direction, and at the rear end of the comb portion, insertion protrusions inserted into the insertion groove are formed in a right and left side direction, and by inserting the insertion protrusion of the comb portion at one side surface along the insertion groove formed at the front end of the plate body, the plate body and the comb portion are integrally coupled, and at a side surface of the teeth protruded to the front of the comb portion, a Printed Circuit Board (PCB) insertion groove is formed, and at the PCB insertion groove, a PCB having a pattern in which a detection signal of the detection line flows is fixed.

At one side of the plate body, a first connection terminal for inputting a signal to the detection line may be provided, and at the other side of the plate body, a second connection terminal for outputting a signal to the detection line may be provided, and the first connection terminal and the second connection terminal may be electrically connected to the detection line.

The second connection terminal may be formed with an elastic terminal to elastic contact with a first connection terminal of an adjacent comb plate.

At one side of the first connection terminal, a third connection terminal may be provided, and at one side of the second connection terminal, a fourth connection terminal may be provided, and a signal output line may be connected thereto, and the signal output line may receive an input of a detection signal, having passed through the detection line to transmit the detection signal to the control means through the third connection terminal.

The detection line may be supported by a support projection formed in the comb portion, and a silicon layer is formed to protect the support projection of a state in which the detection line is supported.

Advantages

According to the present invention, in order to detect damage of teeth of a comb plate fixed to the front of a landing plate, by continuously installing one detection line, it can be monitored whether entire teeth are damaged and a configuration for damage detection is simple.

Particularly, because the present invention uses only one detection line while monitoring the entire of a plurality of comb teeth provided in the comb plate, a cost for monitoring the teeth is minimized.

Further, when the teeth of the comb plate are damaged, by stopping the drive of the escalator, by transmitting comb plate repair request information to a manager at a remote location, and by enabling quick replacement of the comb plate to be performed, a safety accident can be prevented in advance.

Further, by dividedly producing a plate body and a comb portion of the comb plate, when teeth are damaged, only a corresponding comb portion can be replaced and a maintenance cost can be thus reduced.

DETAILED DESCRIPTION OF EXEMPLARY EMBODIMENTS

Figure 1:
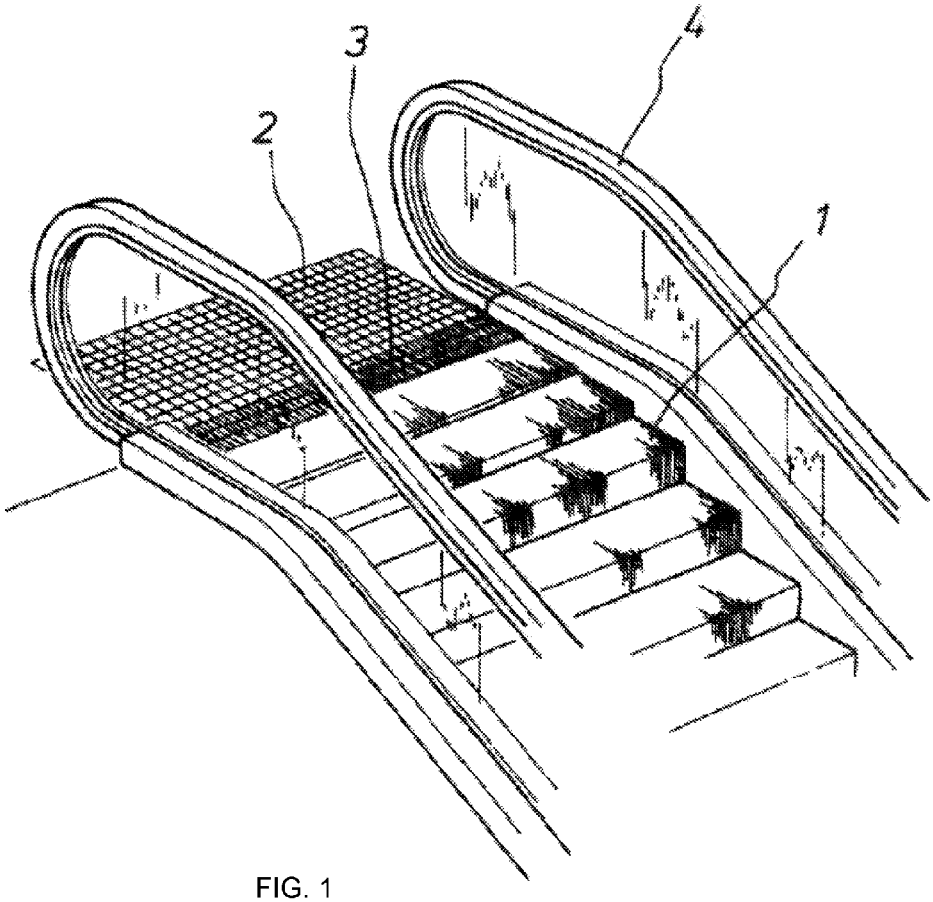
FIG. 1 Prior Art
FIG. 1 is a perspective view of a conventional escalator.
Figure 2:
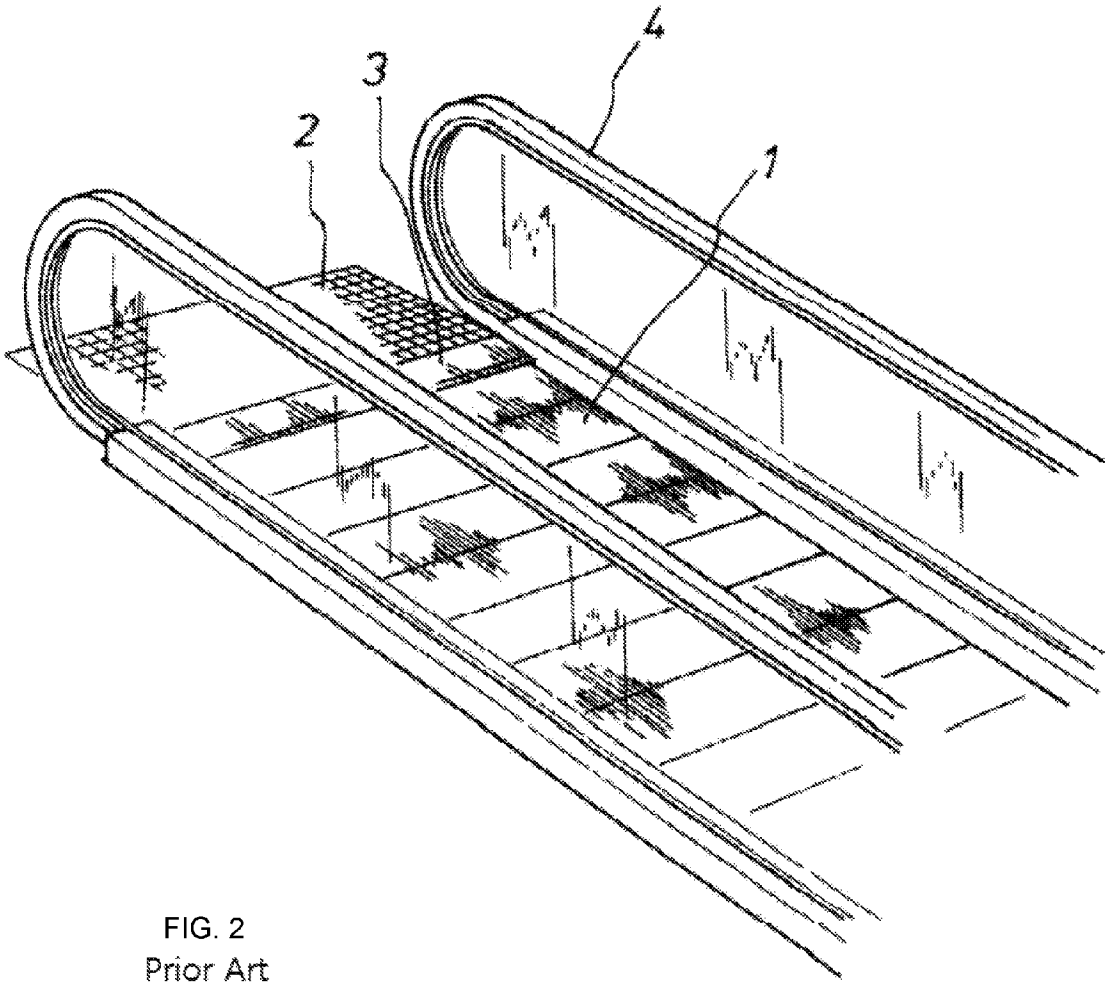
FIG. 2 Prior Art
FIG. 2 is a perspective view of a conventional moving sidewalk.
Figure 3:
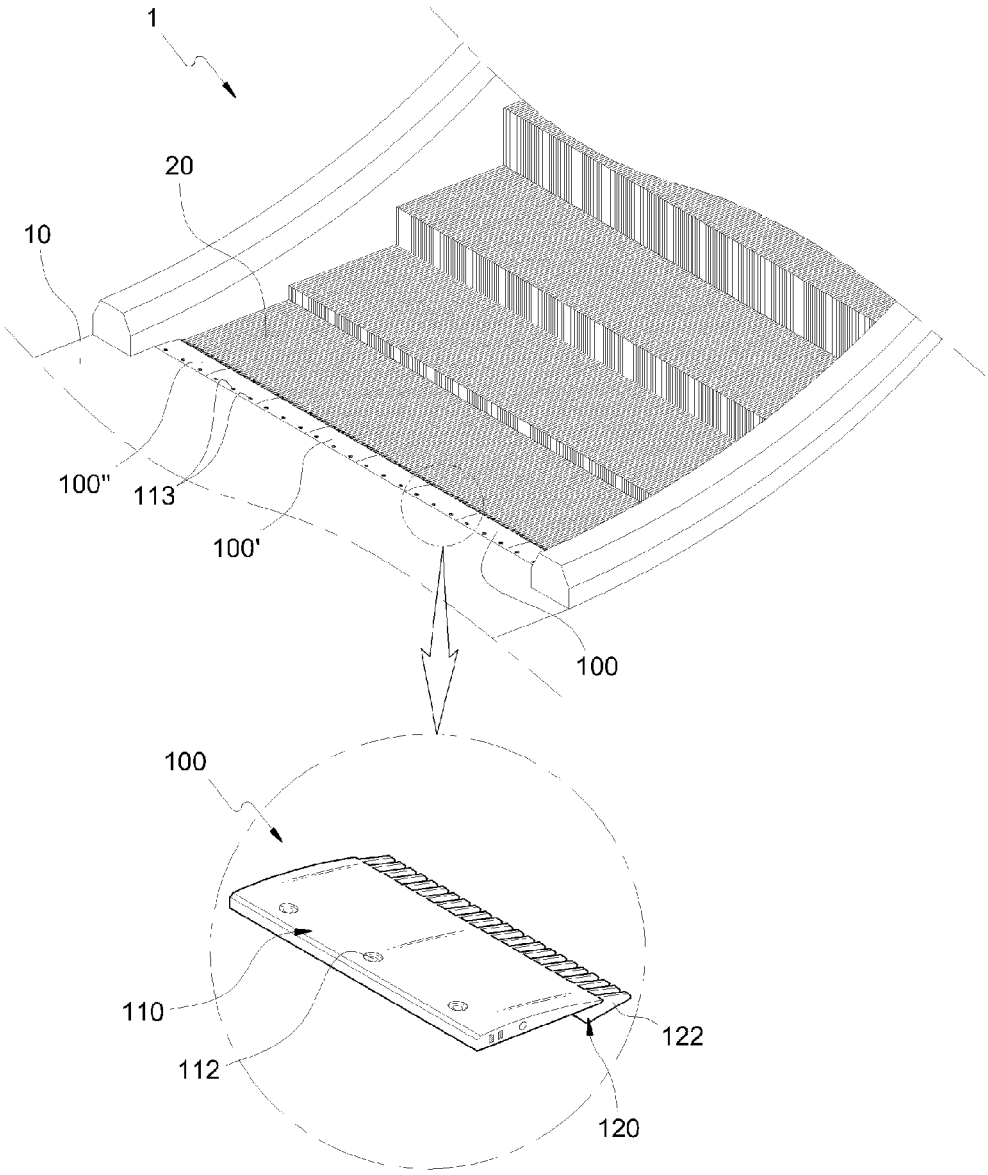
FIG. 3 is a perspective view illustrating a state in which a safety comb plate of an escalator is installed according to an exemplary embodiment of the present invention.
Figure 4:
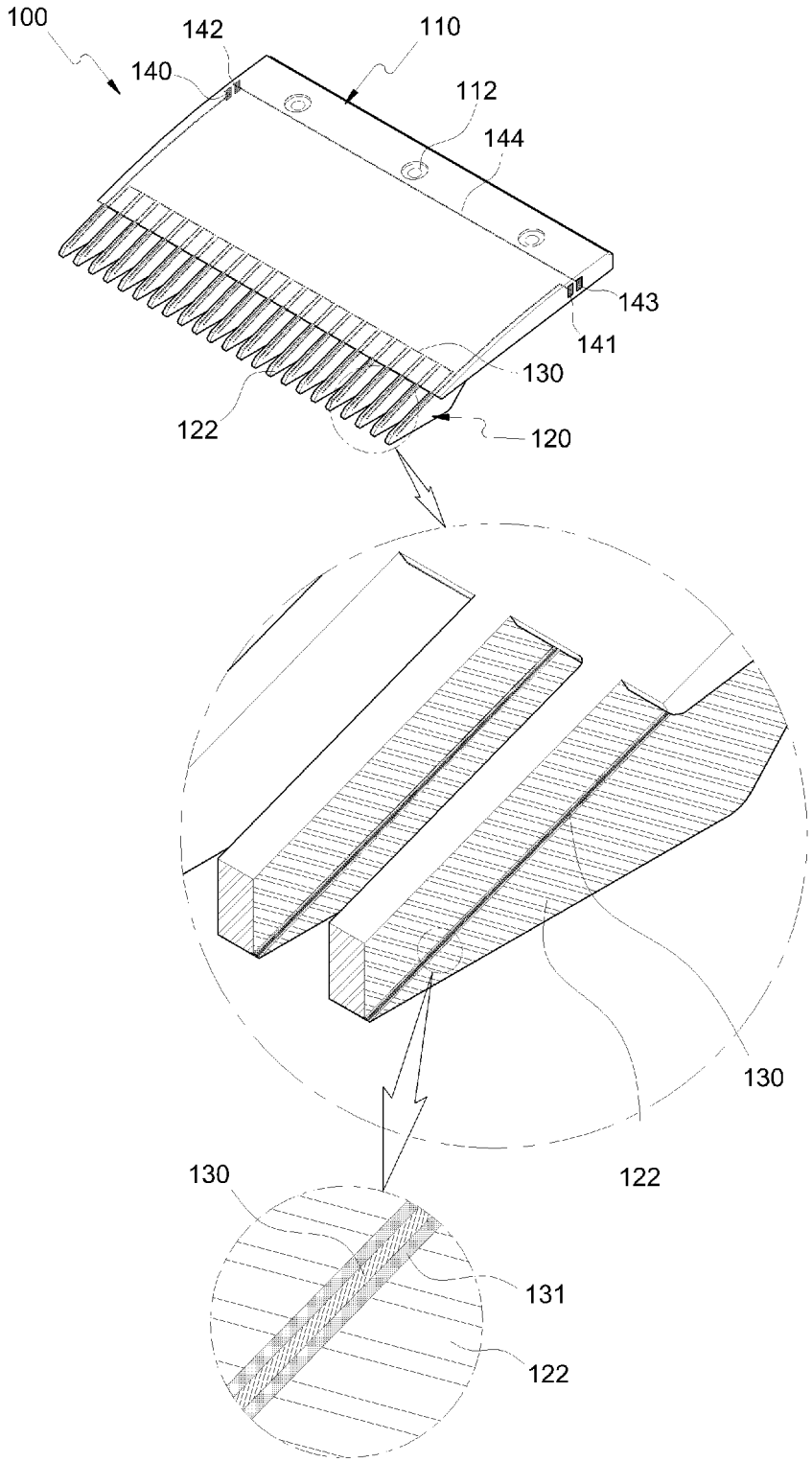
FIG. 4 is a perspective view of a safety comb plate of an escalator according to an exemplary embodiment of the present invention.
Figure 5:
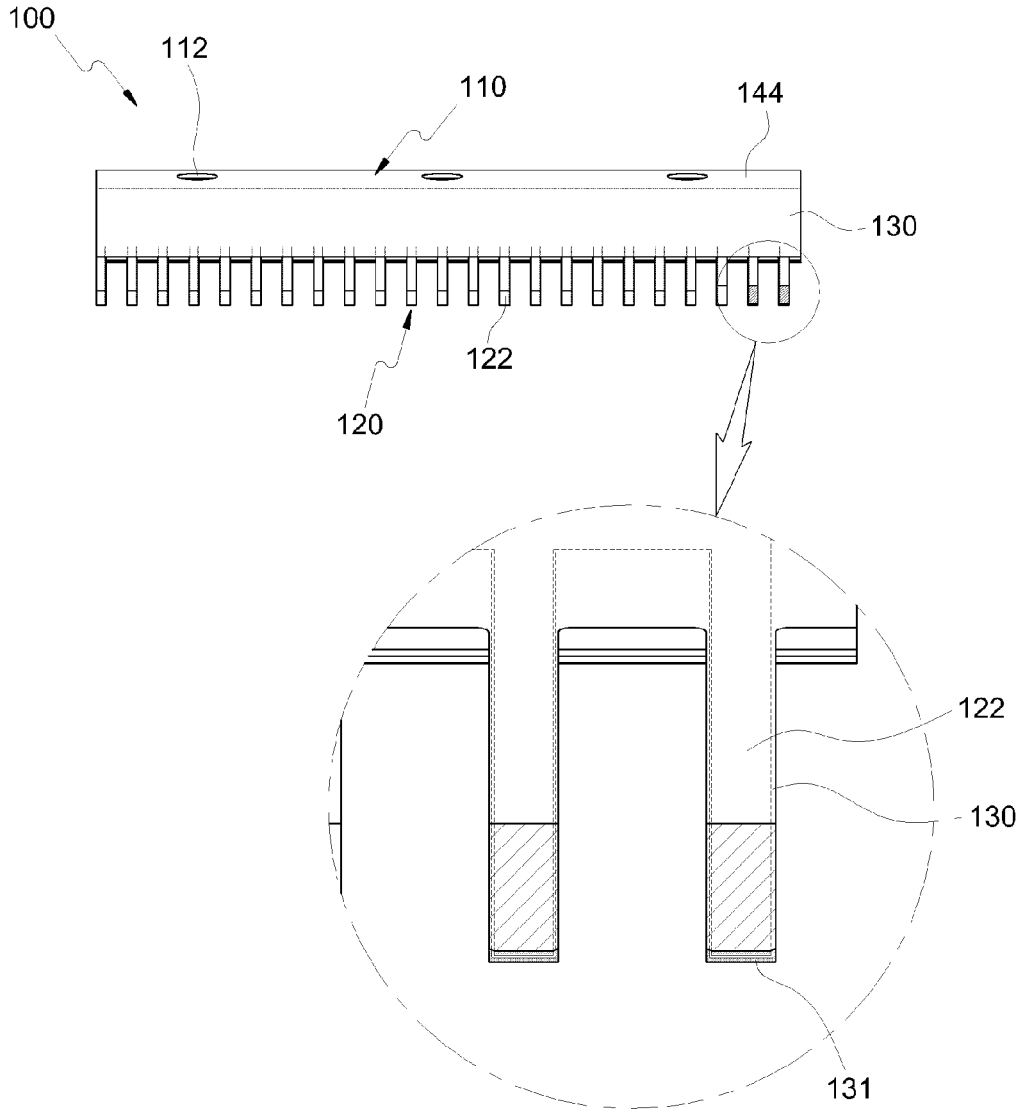
FIG. 5 is a front view of a safety comb plate of an escalator according to an exemplary embodiment of the present invention.
Figure 6:
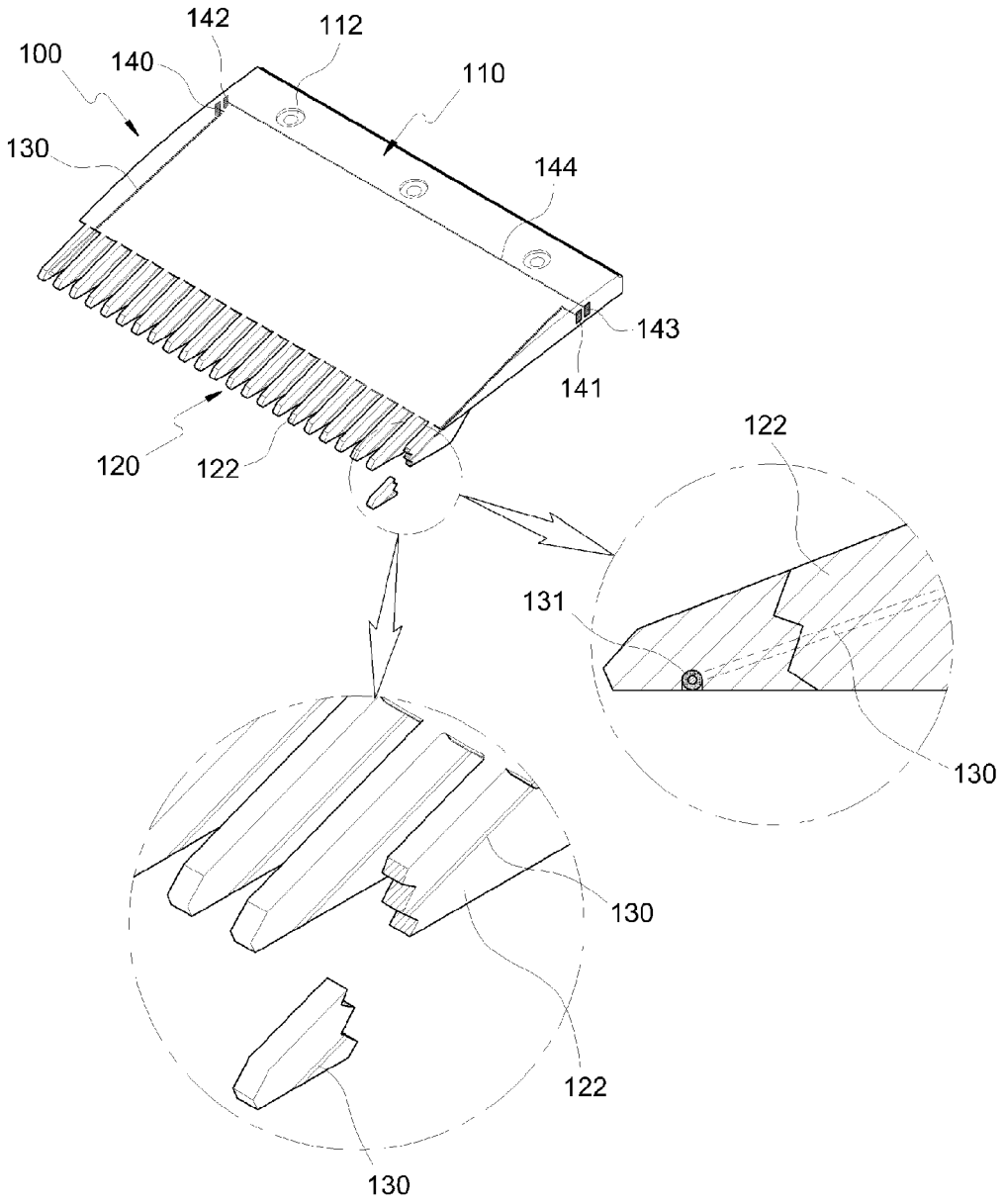
FIG. 6 is a perspective view illustrating a state in which teeth of safety comb plate of an escalator are damaged according to an exemplary embodiment of the present invention.
Figure 7:
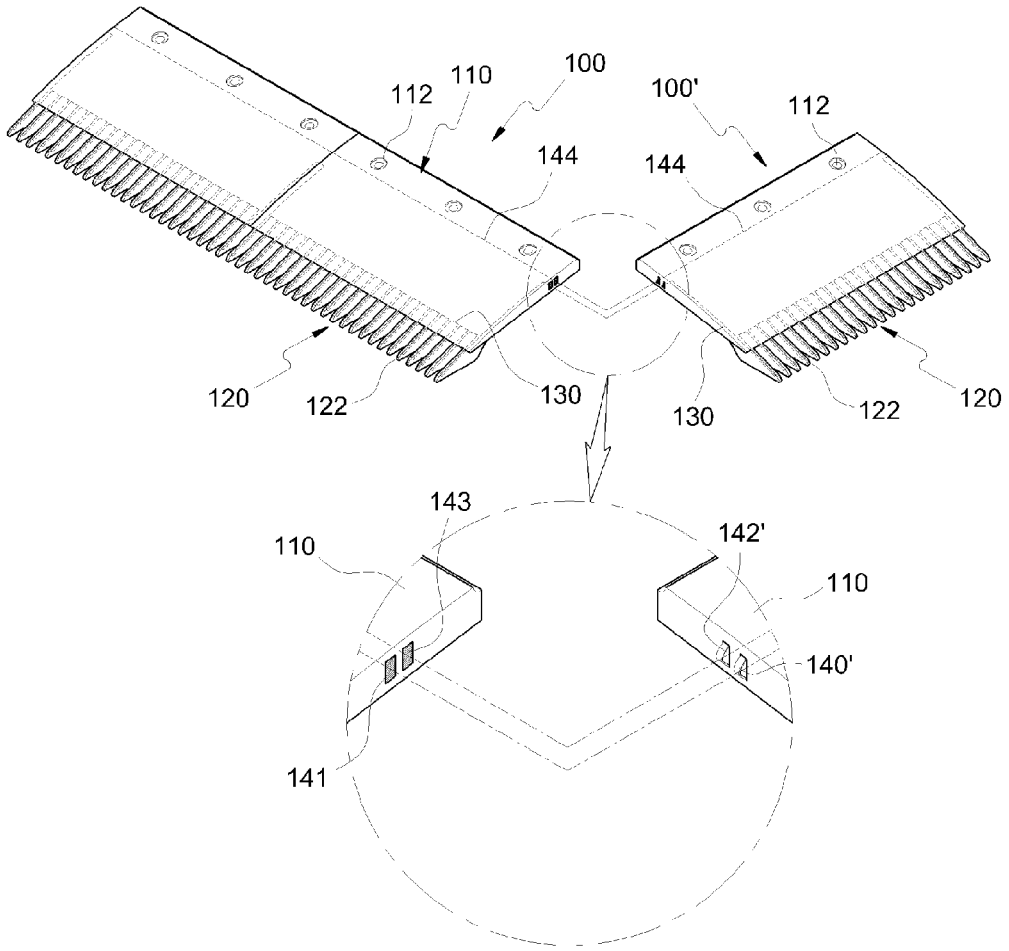
FIG. 7 is a perspective view illustrating an installation state of a safety comb plate of an escalator according to an exemplary embodiment of the present invention.
Figure 8:
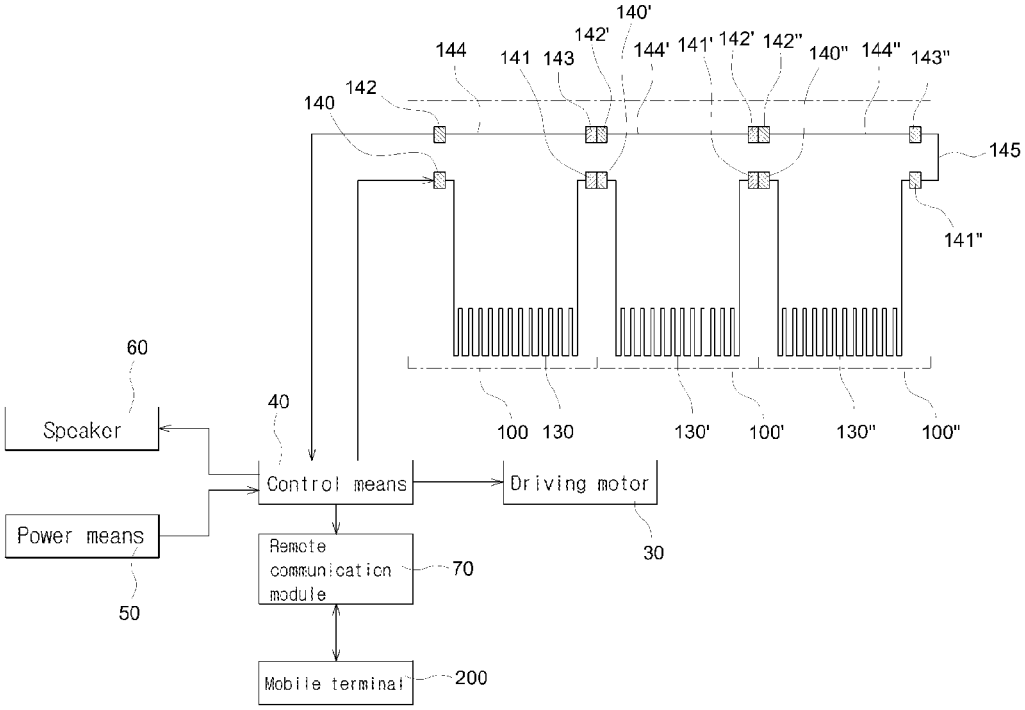
FIG. 8 is a diagram illustrating a configuration of a monitoring system using a safety comb plate of an escalator according to an exemplary embodiment of the present invention.

A safety comb plate of an escalator according to the present invention will be described more fully hereinafter with reference to the accompanying drawings, in which exemplary embodiments of the invention are shown.

The terms used in this specification and claims should not be construed as limited to general or dictionary meanings, and in order for an inventor to describe the invention with a best method, the invention should be interpreted with meanings and concepts corresponding to the spirit of the present invention based on a principle that can appropriately define concepts of terms.

Therefore, embodiments described in this specification and a configuration shown in the drawing are merely an exemplary embodiment of the present invention and do not represent the entire sprit of the present invention and thus it should be understood that various equivalents and exemplary variations that can replace the exemplary embodiment may exist at an application time point of the present invention.

Referring to FIGS. 3 to 8, a safety comb plate 100 of an escalator according to an exemplary embodiment of the present invention is fixedly installed at the front of a landing plate 10 in which a user of an escalator 1 or a moving walk (hereinafter, referred to as an "escalator") steps to prevent a foreign substance attached to or dropped to a foothold 20 from being inserted into an internal apparatus of the escalator.

The comb plate 100 of the escalator 1 is installed in one piece at the front of the landing plate 10 or a plurality of comb plates 100, 100', and 100" divided into at least two are fixedly installed.

Such a comb plate 100 according to an exemplary embodiment of the present invention includes a plate body 110 integrally fixed by a fastening means 113 such as a screw at the front of the landing plate 10 and a comb portion 120 provided at the front end of the plate body 110 and in which a plurality of teeth protruded to the front towards the foothold 20 maintain a constant gap.

In this case, at teeth 122, a detection line 130 for detecting damage of the teeth 122 is provided. Such a detection line 130 may use an electric wire in which a current may flow, and a material of the electric wire may be copper or aluminum.

Hereinafter, each element of the present invention will be described in detail.

The comb plate 100 is produced with a method such as injection molding or die casting and is made of a different material such as a synthetic resin or a metallic material.

In this case, the plate body 110 and the comb portion 120 are integrally formed, and at a surface of the plate body 110, a fixing hole 112 for fixing to the front of the landing plate 10 is formed, and the fastening means 113 such as a screw or a bolt is fastened thereto.

In this case, the plate body 110 is formed in a plate shape and may be made of a material such as a synthetic resin or a metallic material.

The comb portion 120 has a structure in which teeth 122 of a predetermined width (e.g., 2 mm) and a predetermined length (e.g., 4 cm) are protruded, and in order to detect damage thereof, at the teeth 122, the detection line 130 is provided.

In this case, the detection line 130 is integrally fixed so that one detection line 130 continuously encloses an outer peripheral surface of a plurality of teeth 122. In this case, in order to prevent a disconnection of the detection line 130 due to interference of the foothold 20 moving between the teeth 122 and the teeth 122, a fixing groove is formed at a side surface of the teeth 122, and the detection line 130 is thus embedded or fixed by an adhesive or silicon 131.

In this case, the detection line 130 may use a coated electric wire having a structure in which coating is formed within an electric wire having a circular cross-section. The detection line 130 having a strip shape may be attached to a side surface of the teeth 122, and in this case, the comb plate 100 is preferably made of a synthetic resin material.

The detection line 130 may be embedded into the fixing groove formed in a shape '⊃' at one side surface of the teeth 122 and be embedded and fixed by an adhesive or may be embedded into the fixing groove formed in a shape '⊃' while enclosing with the other side surface at one side surface of the teeth 122 and be fixed by an adhesive.

When producing the comb plate 100 with a synthetic resin material, the 20 comb plate 100 may be produced with an insert injection method so that the detection line 130 is located at the inside of the teeth 122. In this case, by preventing the foothold 20 from directly contacting with the detection line 130, a disconnection of the detection line 130 can be more reliably prevented.

In such a comb portion 120, a plurality of teeth 122 are protruded while maintaining a predetermined distance, and one detection line 130 is continuously connected along a side surface of the plurality of teeth 122.

At one side of the comb plate 100, a first connection terminal 140 is provided, and at the other side of the comb plate 100, a second connection terminal 141 is provided and the detection line 130 is connected thereto. More specifically, at one side of the plate body 110, the first connection terminal 140 for inputting a signal to the detection line 130 is provided and at the other side of the plate body 110, a second connection terminal 141 for outputting a signal to the detection line 130 is provided, and the first connection terminal 140 and the second connection terminal 141 are electrically connected to the detection line 130.

In this case, the second connection terminal 141 is formed with an elastic terminal having elasticity to enable to contact with the first connection terminal 140' of the adjacent comb plate 100'. According to such a structure, when continuously fixing the comb plate 100 to the front of the landing plate 10, a detection signal of the detection line 130 between the adjacent comb plates 100 and 100' may be continuously transmitted.

The first connection terminal 140 and the second connection terminal 141 are electrically input to a control means 40 that controls a driving motor 30 that controls the rotation of a foothold 20 of the escalator 1 operating with an endless track.

The control means 40 receives an input of a constant power source such as AC power, which is a power means 50 to control and monitor an entire operation of the escalator.

Such a control means 40 may be formed with, for example, a microcomputer having a memory therein and outputs a detection signal continuously or with a predetermined time interval (e.g., 0.5 second) to the first connection terminal 140 of the comb plate 100, and receives an input of a detection signal output from the second connection terminal 141 of the comb plate 100 to monitor whether the detection signal is input.

At one side of the first connection terminal 140, a third connection terminal 142 is provided, and at one side of the second connection terminal 141, a fourth connection terminal 143 is provided, and when adapting a structure in which a signal output line 144 is connected thereto, by electrically connecting continuously connected second connection terminal 141" and fourth connection terminal 143" of a final comb plate 100", a detected signal may be input to the control means 40 through a third connection terminal 142. In such a structure, a separate wiring for transmitting a detection signal to the landing plate 10 with the control means 40 is not required and thus the comb plate 100 can be easily installed.

At one side of the escalator 1, a speaker 60 is provided to notify abnormality or a failure of the escalator 1, when the teeth 122 are damaged.

The control means 40 outputs repair request information notifying abnormality or a failure of the escalator 1 including damage of the teeth 122 of the comb plate 100 to a remote communication module 70 and notifies the manager of the output repair request information.

Hereinafter, an example of installation and system operation of a safety comb plate of an escalator according to an exemplary embodiment of the present invention will be described.

When continuing to fixing a plurality of comb plates 100 and 100' to the front of the landing plate 10 using the fastening means 113, the first connection terminal 140' and the second connection terminal 141 are electrically connected and a third connection terminal 142 and a fourth connection terminal 143 are electrically connected.

The finally installed second connection terminal 141" and fourth connection terminal 143" of the comb plate 100" form a closed path using a connecting wire 144 such as an electric wire.

In such a state, when the control means 40 outputs a detection signal toward the first connection terminal 140, a detection signal is transmitted along the detection line 130 of each of the comb plates 100, and the detection signal, having passed through the detection line 130 of the entire comb plate 100, 100', and 100" is input to the control means 40. More specifically, the control means 40 receives an input of a detection signal that returns through the signal output line 144 between the third connection terminal 142 and the fourth connection terminal 143.

In this case, when the teeth 122 of a specific comb plate 100 are damaged by a foreign material, the detection line 130 is disconnected and thus a detection signal is not input to the control means 40. Therefore, the control means 40 immediately stops the driving motor 30 that drives the foothold 20 to stop operation of the escalator 1, and outputs with sound a failure message notifying that the escalator 1 has been failed through the speaker 60 to notify a user of the escalator 1.

Further, the control means 40 outputs comb plate repair request information notifying that the teeth 122 of the comb plate 100 are damaged to the remote communication module 70. Therefore, when the teeth 122 of the comb plate 100 are damaged, the control means 40 transmits comb plate repair request information including position data of the escalator 1 through the remote communication module 70.

Accordingly, a manager may determine repair request information through a mobile terminal 200 such as a smart phone.

In this case, because the comb plate repair request information includes position data of the escalator 1 in which corresponding damage has occurred, the manager can determine the escalator 1, arrive at the spot, determine a position of the comb plate 100 having broken teeth with the naked eye, and quickly replace.

Figure 9:
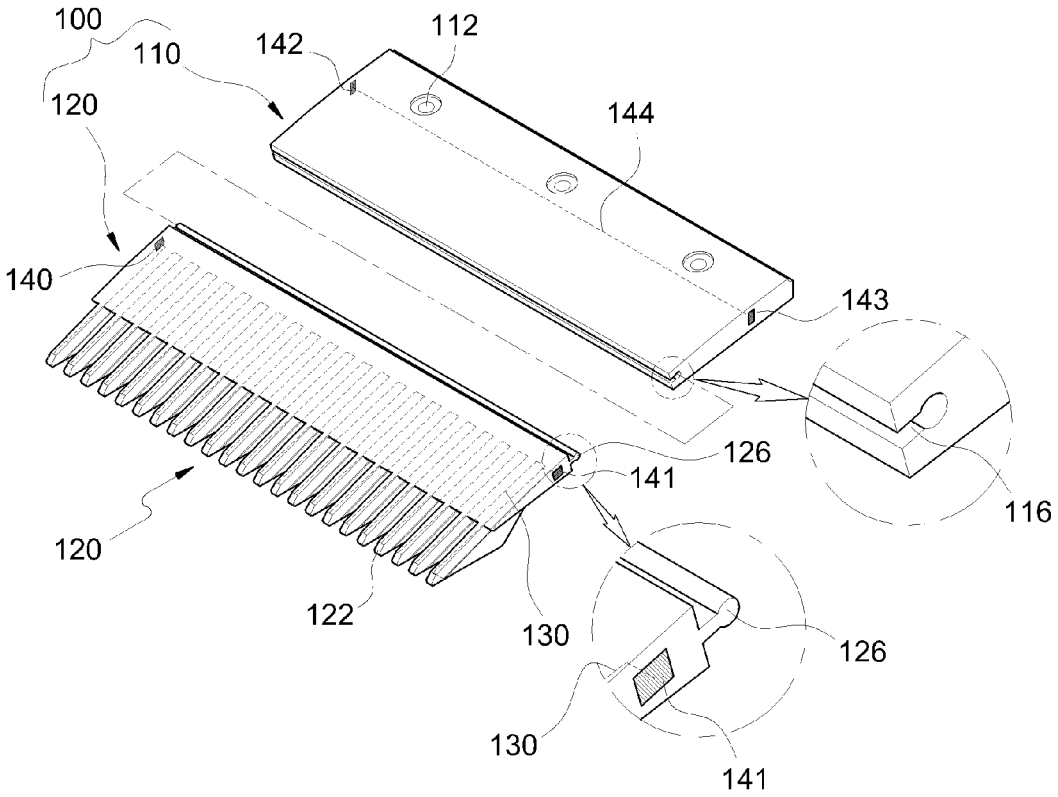
FIG. 9 is an exploded perspective view illustrating a safety comb plate of an escalator according to another embodiment of the present invention.
Figure 9:
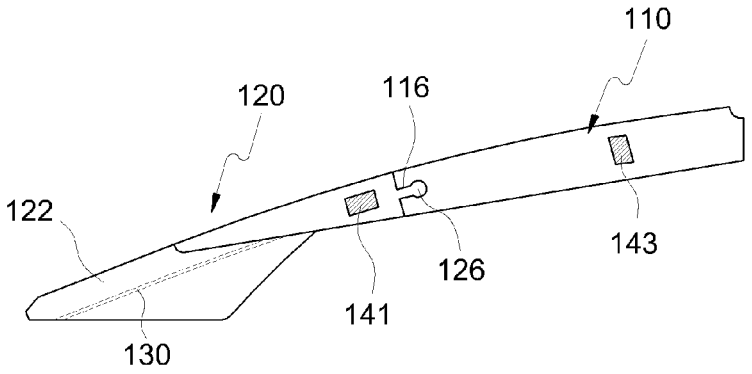

FIG. 9 is an exploded perspective view illustrating a safety comb plate of an escalator according to another embodiment of the present invention.

Referring to FIG. 9, a plate body 110 and a comb portion 120 of a comb plate 100 are dividedly produced.

In this case, at one side of the comb portion 120, a first connection terminal 140 for inputting a signal to a detection line 130 is provided, and at the other side of the comb portion 120, a second connection terminal 141 for outputting the signal to the detection line 130 is provided, and the first connection terminal 140 and the second connection terminal 141 are electrically connected to the detection line 130.

At one side of the plate body 110, a third connection terminal 142 is provided, and at the other side of the plate body 110, a fourth connection terminal 143 is provided and a signal output line 144 is connected thereto.

Further, at the front end of the plate body 110, insertion grooves 116 are formed in a right and left side direction, and at the rear end of the comb portion 120, insertion protrusions 126 to be inserted into the insertion groove 116 are formed in a right and left side direction.

Therefore, by inserting the insertion protrusion 126 of the comb portion 120 at one side surface along the insertion groove 116 formed at the front end of the plate body 110, the plate body 110 and the comb portion 120 are integrally coupled.

According to such a structure, when a manager receives comb plate repair request information with a mobile terminal 200, only the comb portion 120 can be separated and replaced on the spot and thus a maintenance cost can be reduced.

Figure 10:
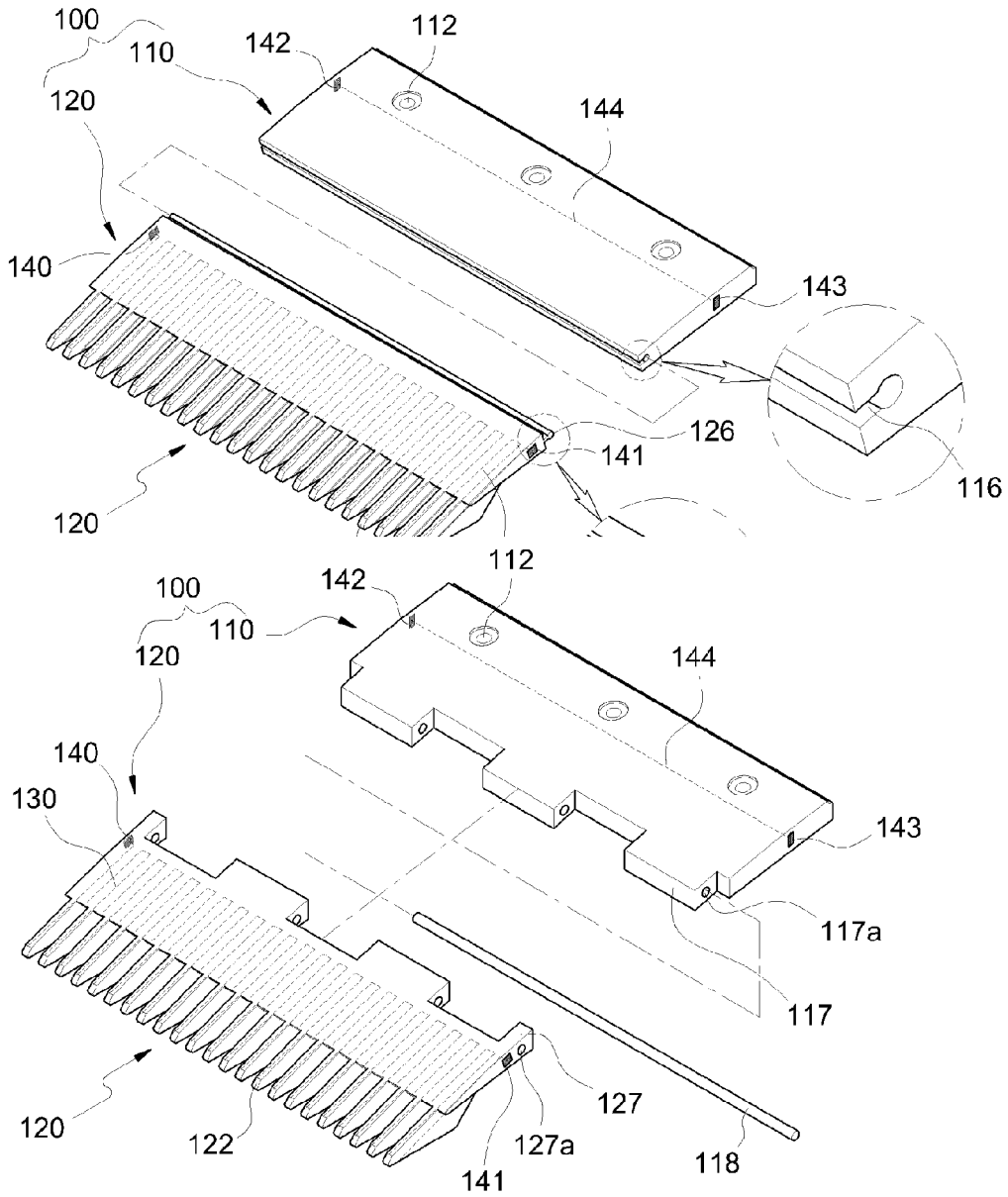
FIG. 10 is an exploded perspective view illustrating a safety comb plate of an escalator according to another embodiment of the present invention.

FIG. 10 is an exploded perspective view illustrating a safety comb plate of an escalator according to another embodiment of the present invention. Referring to FIG. 10, a plate body 110 and a comb portion 120 are dividedly produced, as in an example of FIG. 9.

In this case, at the front end of the plate body 110, a plurality of first coupling projections 117 having first insertion holes 117*a* in a right and left side direction are formed, and at the rear end of the comb portion 120, a plurality of second coupling projections 127 having second insertion holes corresponding to the insertion holes 117*a* in a right and left side direction are formed, and thus the second coupling projection 127 is positioned at one side of the first coupling protrusion 117, and by inserting a fixing pin 118 into the first and second insertion holes 117*a* and 127*a*, the plate body 110 and the comb portion 120 are integrally coupled.

When teeth 122 of the comb plate 100 are damaged, only the comb portion 120 in which the teeth are damaged can be separated and replaced at the spot and thus a maintenance cost can be reduced.

Figure 11:
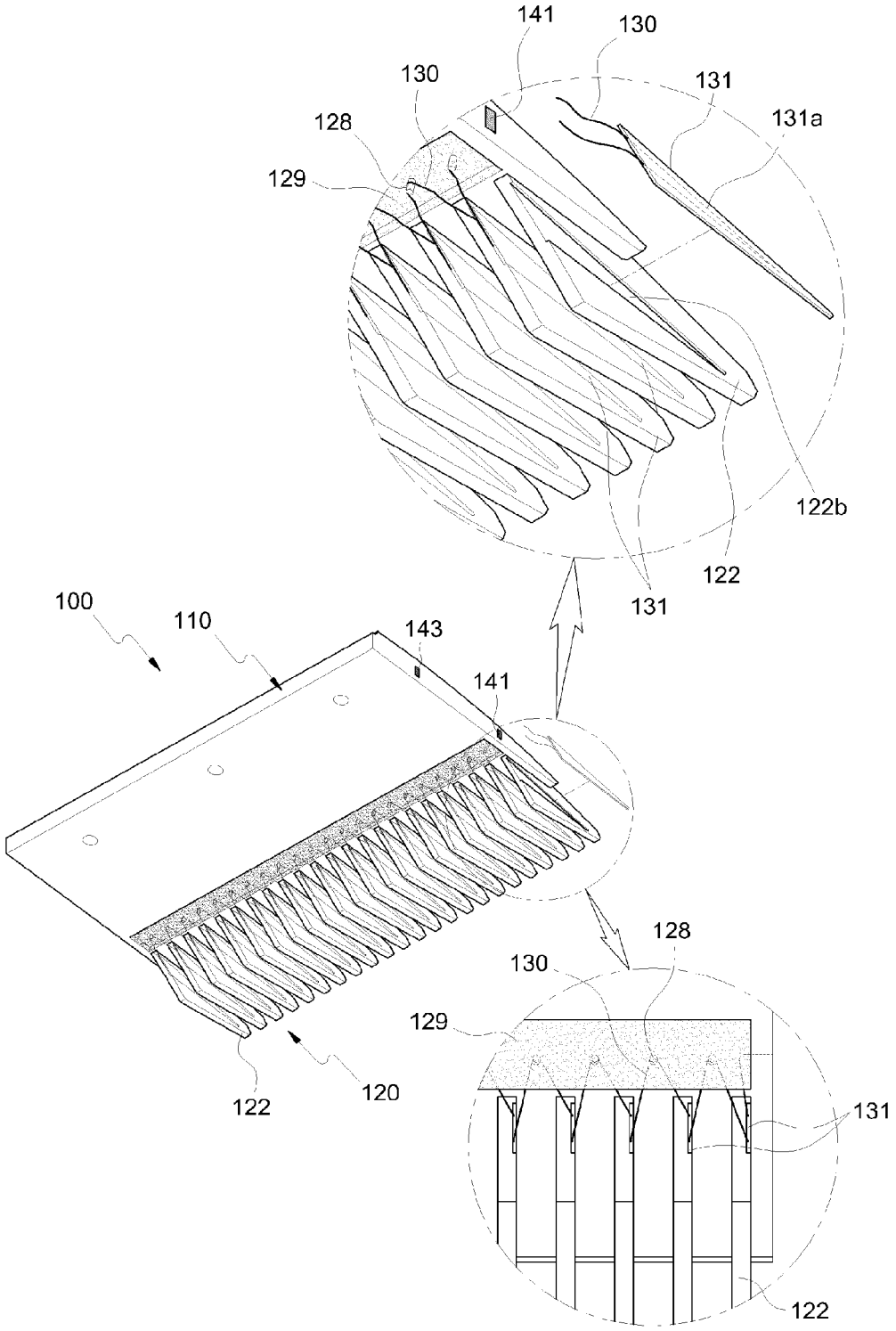
FIG. 11 is a perspective view illustrating a safety comb plate of an escalator according to another embodiment of the present invention.

FIG. 11 is a perspective view illustrating a safety comb plate of an escalator according to another embodiment of the present invention. Referring to FIG. 11, at a side surface of the teeth 122 protruded to the front end of the comb portion 120 of the comb plate 100, a PCB insertion groove 122*b* is formed, and at the PCB insertion groove 122*b*, a PCB 131 having a pattern 131*a* in which a detection signal of a detection line 130 flows is fixed by an adhesive.

The detection line 130 is supported by a support projection 128 formed at the comb portion 120, and a silicon layer 129 to which silicon is applied is formed to protect the support projection 128 of a state in which the detection line 130 is supported.

Therefore, when the teeth 122 of the specific comb plate 100 are damaged by a foreign substance, the detection line 130 and the PCB 131 are disconnected and thus a detection signal is not input to a control means 40, whereby the control means 40 may recognize that the teeth 122 are damaged.

In this case, the control means 40 immediately stops a driving motor 30 that drives a foothold 20 to stop operation of an escalator 1 and outputs with a sound a failure message notifying that the escalator has been failed through a speaker 60, thereby notifying a user of the escalator 1 of the failure message.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

INDUSTRIAL APPLICABILITY

Even if teeth of a comb plate of an escalator are partially damaged, the safety comb plate of the escalator according to the present invention can quickly detect the damage and thus by immediately stopping the drive of the escalator, an unexpected safety accident of a user can be prevented, and when teeth of the comb plate of the escalator are partially damaged, by minimizing a replacement portion, a maintenance cost can be reduced.

What is claimed is:

1. A safety comb plate of an escalator including a plate body fixed to the front of a landing plate and a comb portion provided at the front end of the plate body and in which a plurality of teeth protruded to the front towards a foothold maintain a constant gap, wherein at teeth, a detection line that blocks transmission of a detection signal with a control means that controls driving of the escalator by disconnecting is provided, when the teeth are damaged, the control means determines that the teeth are damaged, when a detection signal is not input from the detection line to stop a driving motor that drives the foothold of the escalator and to output with sound a failure message of the escalator through a speaker, when it is determined that the teeth are damaged, the control means transmits comb plate repair request information notifying that the teeth of the comb plate are damaged to a smart phone, which is a mobile terminal of a manager through a remote communication module, the plate body and the comb portion of the comb plate are dividedly produced, and at the front end of the plate body, insertion grooves are formed in a right and left side direction, and at the rear end of the comb portion, insertion protrusions inserted into the insertion groove are formed in a right and left side direction, and by inserting the insertion protrusion of the comb portion at one side surface along the insertion groove formed at the front end of the plate body, the plate body and the comb portion are integrally coupled, and at a side surface of the teeth protruded to the front of the comb portion, a Printed Circuit Board (PCB) insertion groove is formed, and at the PCB insertion groove, a PCB having a pattern in which a detection signal of the detection line flows is fixed.

2. The safety comb plate of claim 1, wherein at one side of the plate body, a first connection terminal for inputting a signal to the detection line is provided, and at the other side of the plate body, a second connection terminal for outputting a signal to the detection line is provided, and the first connection terminal and the second connection terminal are electrically connected to the detection line.

3. The safety comb plate of claim 2, wherein the second connection terminal is formed with an elastic terminal to elastic contact with a first connection terminal of an adjacent comb plate.

4. The safety comb plate of claim 2, wherein at one side of the first connection terminal, a third connection terminal is provided, and at one side of the second connection terminal, a fourth connection terminal is provided, and a signal output line is connected thereto, and the signal output line receives an input of a detection signal, having passed through the detection line to transmit the detection signal to the control means 40 through the third connection terminal.

5. The safety comb plate of claim 1, wherein the detection line is supported by a support projection formed in the comb portion, and a silicon layer is formed to protect the support projection of a state in which the detection line is supported.

* * * * *